US005775265A

United States Patent [19]

Brandle et al.

[11] Patent Number: 5,775,265

[45] Date of Patent: Jul. 7, 1998

[54] COOLING SURFACE CLADDING

[75] Inventors: Bernd Brandle; Paul Gilli; Werner Holblinger, all of Graz; Emmerich Seidelberger, Vienna, all of Austria

[73] Assignee: Austrian Energy & Environment SGP/Waagner-BIRO GmbH, Vienna, Austria

[21] Appl. No.: 817,992

[22] PCT Filed: Oct. 16, 1995

[86] PCT No.: PCT/AT95/00203

§ 371 Date: Apr. 16, 1997

§ 102(e) Date: Apr. 16, 1997

[87] PCT Pub. No.: WO96/12140

PCT Pub. Date: Apr. 25, 1996

[30] Foreign Application Priority Data

Oct. 17, 1994 [AT] Austria ..... 1952/94

[51] Int. Cl.[6] ..... F22B 37/00

[52] U.S. Cl. ..... 122/6 A; 122/235.11; 122/235.12; 122/235.22

[58] Field of Search ..... 122/6 A, 4 D, 122/235.11, 235.12, 235.22

[56] References Cited

U.S. PATENT DOCUMENTS

| | | | |
|---|---|---|---|
| 2,723,650 | 11/1955 | Beute et al. | 122/235 |
| 2,896,591 | 7/1959 | Schroedter | 122/235.22 |
| 3,265,039 | 8/1966 | Winship et al. | 122/2 |
| 3,498,270 | 3/1970 | Gorzegono et al. | 122/406 |
| 4,301,771 | 11/1981 | Jukkola et al. | 122/4 D |
| 4,537,156 | 8/1985 | Rees | 122/6 A |
| 4,576,120 | 3/1986 | Ammann | 122/6 A |
| 5,269,262 | 12/1993 | Salonen | 122/4 D |
| 5,585,071 | 12/1996 | Hyppanen | 122/4 D |

FOREIGN PATENT DOCUMENTS

| | | |
|---|---|---|
| 1416901 | 9/1965 | France . |
| 2593891 | 8/1987 | France . |

*Primary Examiner*—Henry A. Bennett
*Assistant Examiner*—Jiping Lu
*Attorney, Agent, or Firm*—Steinberg & Raskin, P.C.

[57] ABSTRACT

In a cooling surface cladding for polygonal chambers of steam generators with a hopper-shaped floor and fired on the circulating fluidised bed principle, which consists partially of substantially vertical finned tubes extending in the manner of walls between manifolds and converging curves in the floor region to form a hopper, two opposite finned tube walls (1) in the hopper region, viewed from top to bottom, first form a hopper wall (1') inclined from the vertical over their entire width and then form at least one vertical hopper wall (1") of decreasing width and with partially oblique manifolds (2). In the region of the hopper, viewed from top to bottom, the adjacent tube wall (3) and the tube wall (3') opposite it form first a vertical hopper wall of diminishing width and with oblique manifolds (4) and then an inclined side wall (3") of the hopper of constantly reducing width.

12 Claims, 2 Drawing Sheets

COOLING SURFACE CLADDING

FIELD OF THE INVENTION

The present invention relates to a cooling surface cladding for polygonal chambers of steam generators with hopper-shaped floor and fired on the circulating fluidized bed principle, which consists partially of substantially vertical finned tubes extending in the manner of walls between manifolds and converging curves in the floor region to form a hopper.

BACKGROUND OF THE INVENTION

It is a known method to clad the wall surfaces in steam generators with polygonal combustion chamber cross-section with horizontal or slightly rising and/or with vertical finned tubes on a large surface. Although it is a known procedure to provide complicated tube constructions in realizations, especially in the combustion region, smaller surface parts are walled in and are thus removed from their utilization as cooling surfaces. Hoppers are clad, if at all, by slightly rising tubular bands in the manner of threads.

It is known from U.S. Pat. No. 4,576,120 A and U.S. Pat. No. 4,537,156A to bend tubular walls at an angle to form a combustion chamber hopper and to take the different tube length into account by means of stepped manifolds. This has the disadvantage that many manifolds must be connected, so that this design is not used for small hoppers, i.e. non-combustion chamber hoppers. Also, the utilization of our design is possible even with slightly heated tubular walls, while the utilization of the known design in non-radiation heating surfaces (outside the combustion chamber) may lead to circulation difficulties which can be safely avoided thanks to the partial incorporation into the downpipe system according to our invention.

Modern firing systems, such as for example the circulating fluidized bed combustion, require greater attention to small, generally hard to cool partial surfaces in view of economy, and a special wall design, in particular in the hopper and/or cyclone or recycling part. Since lined wall elements reduce the start-up speed, they should be avoided as much as possible.

OBJECTS AND SUMMARY OF THE INVENTION

The invention has as its object to incorporate also components not belonging to the combustion chamber and in part small components into the cooling system and to provide a finned tube wall connected to the circulation of the steam generator by means of a special configuration of the components and/or of the lining tubes.

The invention is characterized in that two finned tube walls across from each other in the hopper area, as seen from above, constitute first a hopper wall which is inclined from the vertical, and then at least one hopper wall with a diminishing width and in part inclined manifolds, and in that the adjacent tube wall and the tube wall across from it in the hopper area (as seen from above) constitute a lateral wall of the hopper which is inclined from the vertical with diminishing width and inclined manifolds and then with constantly diminishing width.

In certain embodiments, inclined manifolds are connected to the tube wall by connection pieces installed at an angle to the axis of the manifold. The inclined manifolds of adjacent walls may be positioned at different heights. Also, a lower inclined manifold may be located in the downpipe system of the steam generator so that the finned tube wall belongs in part to the downpipe system and in part to the ascending pipe system.

When two adjacent hopper chambers are separated from each other by an intermediate wall heated on both sides, as in one embodiment in accordance with the invention, the tubes of the intermediate wall are continued alternately into an inclined hopper wall. On the other hand, when two adjacent hopper chambers without an intermediate wall are clad, the tubes of the intersecting inclined hopper walls are taken into the adjoining vertical hopper wall and only the longer portion of the vertical tubes of the intersecting inclined hopper walls are introduced into the inclined manifolds.

The essential advantages of the invention lie in the fact that in spite of the difficult pipe arrangement, more heat exchange surfaces can be provided in the given space and that the heat tensions during start-up and shut-off are reduced in spite of a more rapid load change, because all the wall elements are cooled uniformly, so that heat elasticity increases. The new hopper design is advantageously also suitable for combustion chamber hoppers.

BRIEF DESCRIPTION OF THE DRAWINGS

The invention is shown in the attached drawings through examples and schematically.

DETAILED DESCRIPTION OF THE PREFERRED EMBODIMENTS

Figure 1:
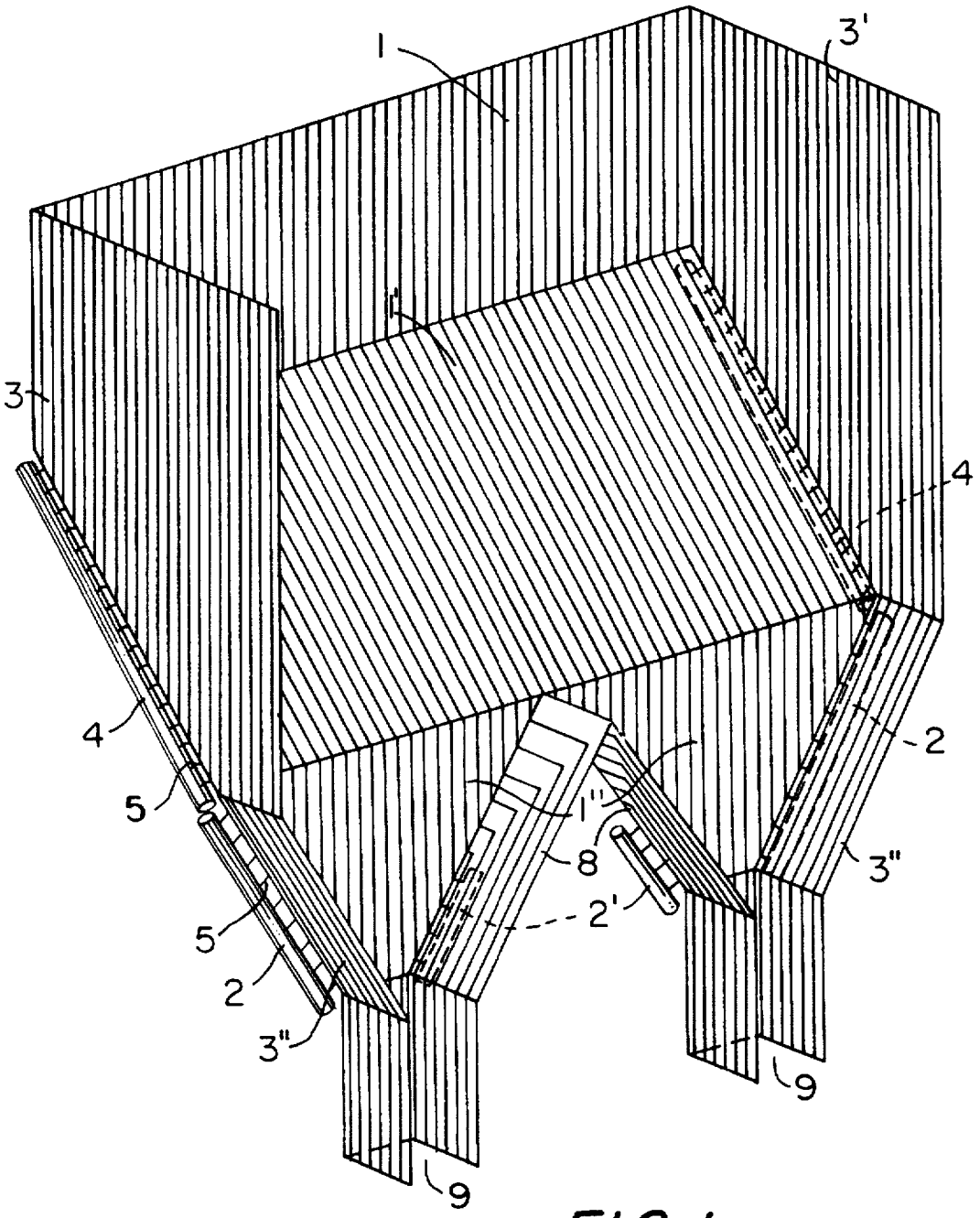
FIGS. 1 and 2 show at an angle two variations of an embodiment of a funnel-shaped floor of a steam generator which is completely lined with finned tube heating surfaces.
Figure 2:
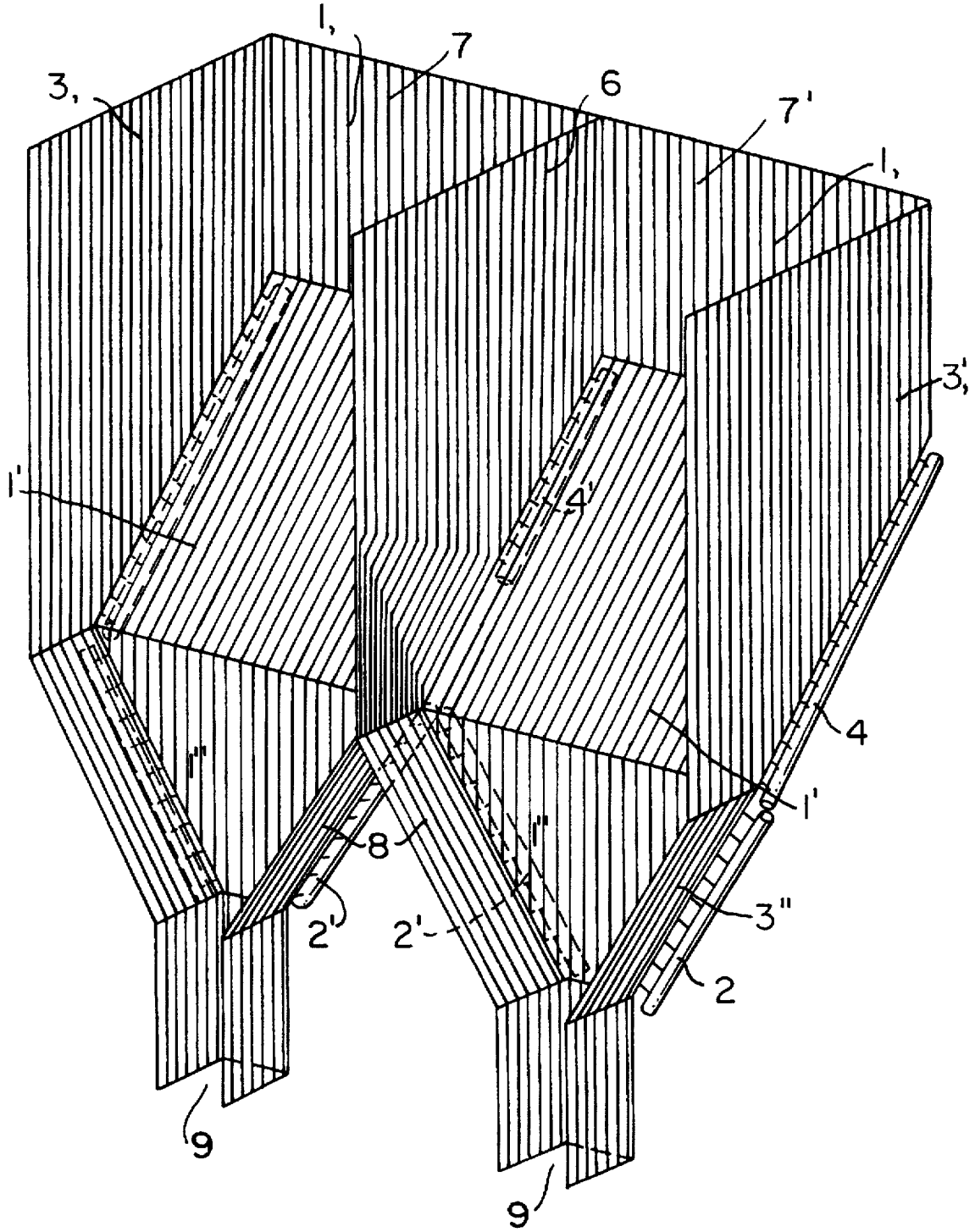

FIG. 1 shows a combustion chamber without, and FIG. 2 with intermediate wall heated from both sides, in a section.

In FIG. 1 a hopper-shaped combustion chamber floor is shown, which is subdivided by an intermediate wall into two outlets. The finned tube wall 1 is curved at an angle over its entire width and constitutes funnel wall 1'. This funnel wall 1' is finally curved once more in the direction of the vertical, whereby it tapers downward. This is achieved in that the tubes no longer used are brought to the outside, and are incorporated into a manifold 2, if necessary through inclined connection pieces. The remaining tube wall 1" may be continued if necessary and forms a wall of channel 9 through which solids are removed. The tube wall 3 or 3' connected to the finned tube wall 1 tapers in the vertical position downward, with the extra tubes being introduced into the manifold 4 via the connection pieces 5. Thereupon the remaining portions of the tube wall 3 remain curved at an angle and constitute the lateral wall 3" of the hopper. This tube wall is then connected to the hopper wall 1" in a known manner. Finally the lateral wall 3" can again be curved into the vertical in order to constitute an additional wall of the channel 9. In this hopper design adjacent tube walls 1, 3 and 3" have different length before their first curve in order to form the hopper, whereby the tubes no longer needed in the adjacent, inclined tube wall part 1' and 3" are introduced at least in part into inclined collecting chambers 4 or 2.

Finally, two more internal hopper walls 8 are provided, which are connected to the hopper wall 1" for cooling and into which the shorter tubes of the hopper wall 1" are introduced after a curve of 90° for each into the hopper wall 8 and represent the cladding. Also in this case the hopper wall 8 can be merged into the wall of channel 9. In this design it is essential that the longer tubes of the hopper wall 1" in the area of hopper wall 8 be incorporated in a manifold 2' which is shorter by about one half than the manifold 2.

This measure of special hopper configuration makes it possible to realize also the cladding of complicated finned tube wall constructions such as are used e.g. in fluidized bed combustion installations with circulating fluidized layer with relative ease, especially in the area of returning the fluidized material into the combustion chamber where the inner surfaces are completely clad with cooling surfaces. When these heating surfaces are only slightly heated, they can be incorporated at least in part into the downpipe system of the steam generator, whereby the pipes connected to the manifolds 2 and which are therefore at the deepest location, are advantageously used. It is thus absolutely possible for part of the finned tube wall 1 to be located in the ascending pipe system, while another part is located in the downpipe system.

FIG. 1 is different from FIG. 2 not only in that the view is changed but also through the introduction of an intermediate wall 6, so that the space enclosed by the tube walls is subdivided. This results in switching changes for the tubes. First only part of the tubes, i.e. the longer tubes of the intermediate wall are introduced into the lower part of the hopper, while the shorter tubes let out in a manifold 4' at the underside of the funnel wall 1'. The longer tubes are sealed in the intermediate wall and are incorporated into the hopper walls 8 after being spread, in such manner that the individual tubes installed and sealed in the intermediate wall 6 merge alternately into one of the two inclined hopper walls 8. Thus the tubes of the hopper wall 8 are simply shifted relative to FIG. 1, and the manifolds designated as the shorter manifolds 2' in FIG. 1 are substantially of equal dimension as the manifolds 2 and receive a major portion of the tubes of the hopper wall 1". The cladding of the walls of the connected channel 9 can be similar to that shown in FIG. 1.

We claim:

1. Cooling surface cladding for a chamber of a steam generator, comprising first and second opposed walls, each of said first and second walls including a plurality of medium-carrying tubes and having a first substantially vertical portion, a second portion arranged adjacent a bottom of said first portion and inclined toward the other of said first and second walls, and at least one additional substantially vertical portion arranged adjacent a bottom of said second portion, the width of said at least one additional portion decreasing from the bottom of said second portion to a bottom of said at least one additional portion, the number of said tubes in said second portion of said first and second walls being greater than the number of said tubes at said bottom of said at least one additional portion such that at least a portion of said tubes in said first and second walls terminate in said at least one additional portion, first collecting means arranged in flow communication with said portion of said tubes terminating in said at least one additional portion for collecting medium from said portion of said tubes terminating in said at least one additional portion, third and fourth opposed walls extending between said first and second walls, each of said third and fourth walls including a plurality of medium-carrying tubes and having a first substantially vertical portion having a substantially uniform width and being connected to said first portion of said first and second walls, a second portion arranged adjacent a bottom of said first portion, said second portion having a width decreasing from the width of said first portion to a bottom of said second portion and being connected to said second portion of said first and second walls, and a third portion having a substantially uniform width and being arranged adjacent the bottom of said second portion, said third portion of each of said third and fourth walls being inwardly inclined toward the other of said third and fourth walls, the number of said tubes in first portion of said third and fourth walls being greater than the number of said tubes at the bottom of said second portion of said third and fourth walls such that at least a portion of said tubes in said third and fourth walls terminate in said second portion of said third and fourth walls, and second collecting means arranged in flow communication with said portion of said tubes terminating in said second portion for collecting medium from said portion of said tubes terminating in said second portion of said third and fourth walls.

2. The cooling surface cladding of claim 1, wherein said first collecting means comprise manifolds and connection pieces for connecting said portion of said tubes terminating in said at least one additional portion to one of said manifolds.

3. The cooling surface cladding of claim 2, wherein each of said manifolds is substantially cylindrical and is inclined with respect to said at least one additional portion of a respective one of said first and second walls, said connection pieces being arranged at an angle to a central axis of the respective connecting one of said manifolds.

4. The cooling surface cladding of claim 2, wherein said first portion of said first and second walls has a width substantially equal to the width of said second portion of said first and second walls.

5. The cooling surface cladding of claim 1, wherein said second collecting means comprise manifolds and connection pieces for connecting said portion of said tubes terminating in said second portion to one of said manifolds.

6. The cooling surface cladding of claim 5, wherein each of said manifolds is substantially cylindrical and is inclined with respect to said second portion of a respective one of said third and fourth walls, said connection pieces being arranged at an angle to a central axis of the respective connecting one of said manifolds.

7. The cooling surface cladding of claim 1, wherein said at least one additional portion arranged adjacent the bottom of said second portion of each of said first and second walls comprises two additional vertical portions, the width of each of said two portions decreasing continuously from the bottom of said second portion, further comprising first and second internal hopper walls arranged between said third and fourth walls such that a first hopper is defined by a first one of said two additional vertical portions of said first and second opposed walls, said third portion of said third wall and said first internal hopper wall and a second hopper is defined by a second one of said two additional vertical portions of said first and second opposed walls, said third portion of said fourth wall and said second internal hopper wall.

8. The cooling surface cladding of claim 7, wherein said first and second internal hopper walls comprise medium-carrying tubes each connected to a respective one of said tubes in said first and second walls.

9. The cooling surface cladding of claim 8, wherein said first collecting means are structured and arranged to collect medium from said portion of said tubes terminating in said two additional portions, said first collecting means comprising manifolds and connection pieces for connecting said portion of said tubes terminating in said two additional portions to one of said manifolds.

10. The cooling surface cladding of claim 9, wherein said first and second internal hopper walls are inclined over a certain horizontal distance in relation to said first and second walls, the number of tubes in said first and second walls over the horizontal distance being greater than the number of tubes in said first and second internal hopper walls such that a portion of said tubes in said first and second walls are fluidly connected to one of said manifolds.

11. The cooling surface cladding of claim 1, further comprising an intermediate wall arranged between said third and fourth walls such that said third wall and said fourth wall are both in opposed relationship to said intermediate wall and extending between said first and second walls, said intermediate wall comprising medium-carrying tubes.

12. The cooling surface cladding of claim 11, wherein said at least one additional portion arranged adjacent the bottom of said second portion of each of said first and second walls comprises two additional vertical portions, the width of each of said two additional vertical portions decreasing continuously from the bottom of said second portion, further comprising first and second internal hopper walls arranged between said third and fourth walls such that a first hopper is defined by a first one of said two additional vertical portions of said first and second opposed walls, said third portion of said third wall and said first internal hopper wall and a second hopper is defined by a second one of said two additional vertical portions of said first and second opposed walls, said third portion of said fourth wall and said second internal hopper wall, said first and second internal hopper walls comprising medium-carrying tubes being connected to a respective one of said tubes in said intermediate wall.

* * * * *